US005387317A

United States Patent [19]

Parthasarathy et al.

[11] Patent Number: 5,387,317

[45] Date of Patent: Feb. 7, 1995

[54] OXYGEN/OZONE/PERACETIC AICD DELIGNIFICATION AND BLEACHING OF CELLULOSIC PULPS

[75] Inventors: Venketa R. Parthasarathy; Glenn F. Rudie, both of Chillicothe, Ohio

[73] Assignee: The Mead Corporation, Dayton, Ohio

[21] Appl. No.: 10,533

[22] Filed: Jan. 28, 1993

[51] Int. Cl.[6] ..... D21C 9/147; D21C 9/153; D21C 9/16

[52] U.S. Cl. ..... 162/65; 162/76; 162/78

[58] Field of Search ..... 162/65, 76, 78, 88, 162/89, 56, 18, 19

[56] References Cited

U.S. PATENT DOCUMENTS

| | | | |
|---|---|---|---|
| 3,832,276 | 8/1974 | Roymoulik et al. | 162/65 |
| 4,080,249 | 3/1978 | Kempf et al. | 162/57 |
| 4,216,054 | 8/1980 | Bentvelzen et al. | 162/65 |
| 4,294,654 | 10/1981 | Turner | 162/50 |
| 4,427,490 | 1/1984 | Eckert | 162/78 |
| 4,626,319 | 12/1986 | Knuger et al. | 162/65 |
| 4,793,898 | 12/1988 | Laamanen et al. | 162/76 |
| 5,074,960 | 12/1991 | Nimz et al. | 162/65 |
| 5,091,054 | 2/1992 | Meier et al. | 162/65 |
| 5,188,708 | 2/1993 | Griggs et al. | 162/65 |

FOREIGN PATENT DOCUMENTS

| | | | |
|---|---|---|---|
| 2031848 | 6/1991 | Canada | 162/65 |
| 0397308 | 11/1990 | European Pat. Off. | 162/65 |
| 2620744 | 9/1987 | France | 162/65 |

OTHER PUBLICATIONS

Liebergott et al, "$O_2$, $O_3$ and Peroxide", Pulping & Bleaching Seminar, New Orleans, La., Nov. 1978.

Medwich V. Byrd, Jr. "Delignification and Bleaching of Chemical Pulps with Ozone:" a Literature Review Tappi Journal, 207–213, Mar. 1992.

*Primary Examiner*—Steven Alvo

*Attorney, Agent, or Firm*—Thompson, Hine & Flory

[57] ABSTRACT

A method for delignification and bleaching of cellulosic pulp which comprises reacting a cellulosic pulp with peracetic acid, ozone and oxygen under conditions of acidic pH. The ozone substantially completely reacts with the pulp and, thereafter, the oxygen reacts with the pulp under under an acidic pH.

13 Claims, 1 Drawing Sheet

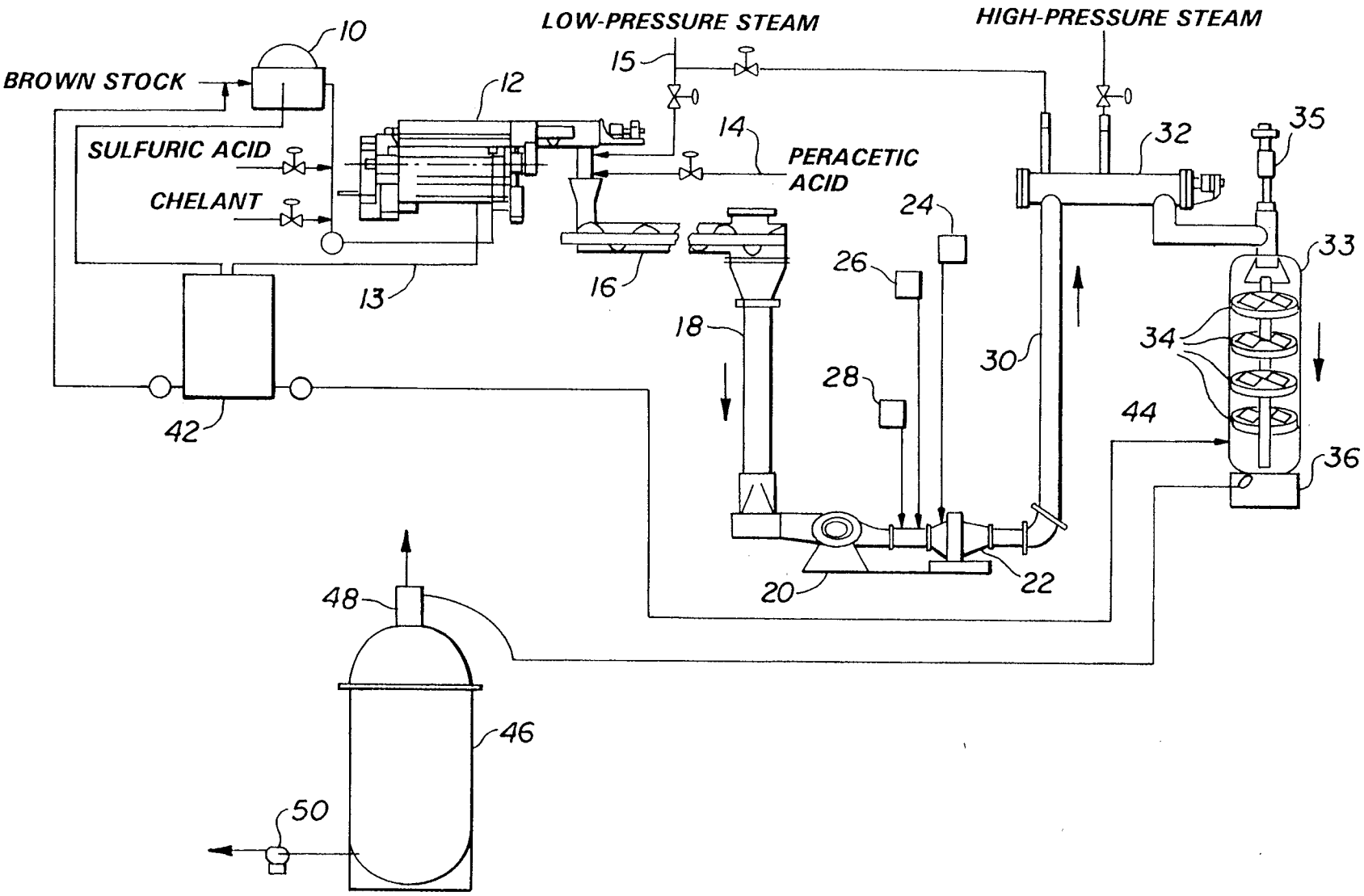
HIGH-PRESSURE STEAM
LOW-PRESSURE STEAM
PERACETIC ACID
BROWN STOCK
SULFURIC ACID
CHELANT
10
12
13
14
15
16
18
20
22
24
26
28
30
32
33
34
35
36
42
44
46
48
50

OXYGEN/OZONE/PERACETIC AICD DELIGNIFICATION AND BLEACHING OF CELLULOSIC PULPS

BACKGROUND OF THE INVENTION

1. Field of the Invention

The present invention relates generally to a method of delignifying and bleaching cellulosic pulps. More particularly, the invention relates to a totally molecular chlorine-free method of delignifying and bleaching chemical cellulosic pulps using a combination of peracetic acid, ozone and oxygen.

2. Description of the Prior Art

Conventional methods of processing cellulosic pulps generally include multiple delignification steps. In order to obtain a final pulp of sufficient brightness, most industrial processes rely upon bleaching the pulp with chlorine-based bleaching agents. Molecular chlorine and, more recently, chlorine dioxide have been used in these processes. However, the use of chlorine-based bleaching agents has met with increasing objections and strict legislation has been proposed in an effort to force replacement of such chlorine bleaches in lignocellulose processes with non-chlorine based bleaches.

The pulp and paper industry has devoted substantial efforts to the development of chlorine-free or reduced chlorine bleaching processes. One such effort has been the development and implementation of oxygen bleaching systems. U.S. Pat. No. 3,832,276 to Roymoulik discloses one oxygen delignification process. Oxygen itself, however, cannot produce pulps of sufficiently high brightness and quality for many commercial applications. U.S. Pat. No. 4,626,319 to Kruger et al. teaches the use of oxygen and hydrogen peroxide in the diligniification and bleaching of cellulose. The ineffectiveness of oxygen in the bleaching of pulps has led other researchers to investigate the use of ozone as a bleaching agent, either alone or following an oxygen bleaching stage. Oxygen and ozone bleaching of cellulosic pulps are generally carried out separately because ozone is intolerant of alkaline conditions and oxygen is inefficient in an acidic environment.

For a review of the literature relating to the ozone bleaching of fibrous materials reference can be made to Medwich v. Byrd, Jr. "Delignification and Bleaching of Chemical Pulps with Ozone: a Literature Review" *Tappi Journal,* 207–213, March 1992.

U.S. Pat. No. 4,080,249 to Kempf teaches the use of a mixture of about 0.1 to 20% ozone in oxygen or air to delignify and bleach cellulose pulp. The delignification and bleaching sequence may include a first stage where oxygen is employed as a reactant in the presence of an alkali.

U.S. Pat. No. 5,074,960 to Nimz et al. teaches the use of ozone in the presence of a $C_{1-3}$ fatty acid to remove lignin from a cellulosic or lignocellulosic pulp. The ozone is present at a concentration of about 0.1 to 10% in a gaseous phase consisting of air or oxygen.

In the prior bleaching processes which employ oxygen and ozone in separate stages or individual unit operations, there is a substantial change in the process pH from strongly alkaline for oxygen delignification to very acidic for ozone delignification. The control of pH is critical at these two extremes. For this reason, the oxygen and ozone treatments are separated. They are conducted in separate towers and the pulp is washed between each treatment. In ozone treatments, oxygen is presented as a carrier-gas and occupies almost 90% of the total weight of the gas stream but oxygen is essentially inert and inactive under the process conditions employed in these reactions.

SUMMARY OF THE INVENTION

The object of this invention is to provide a method for delignification and bleaching cellulosic pulp employing a combination of per. acetic acid (Pa), ozone (Z) and oxygen (0) in a single operation, e.g., without dividing the process into separate stages by intermediate washing steps. This and other objects are achieved in accordance with the present invention which, in one embodiment, provides a method for the delignification and bleaching of cellulosic pulp which comprises reacting a cellulosic pulp with peracetic acid, ozone and oxygen under an acidic pH.

The process of the present invention results in a high brightness pulp having reduced color while substantially decreasing or eliminating the presence of organochlorine from the reaction effluent.

BRIEF DESCRIPTION OF THE DRAWING

The single Figure is a schematic illustration of an installation for carrying out the delignification and bleaching process of the present invention.

DETAILED DESCRIPTION OF THE INVENTION

The process of the present invention can be used for the delignification and/or bleaching of hardwood or softwood mechanical, chemical or chemimechanical pulps such as Kraft and sulfite pulps. However, the high lignin content of refiner mechanical pulps generally makes them undesirable for use in the invention.

Prior to delignification, the pulp (brownstock) is treated witch a chelating agent to passivate transition metal ions in the pulp. The presence of transition metal ions in the pulp during the process of the present invention is disadvantageous for two reason: it depletes the amount of the chemicals added to the pulp and it generates byproducts which reduce pulp yields. The metal ions can react with the peracetic acid, the peroxide generated in the process, ozone and oxygen to produce hydroxy radicals. These hydroxy radicals attack the cellulose in the pulp and reduce yields.

Any chelating agent conventionally used in the paper industry should be useful in the present invention. A typical example of a useful chelating agent is ethylenediamine tetraacetic acid (EDTA). The chelating agent is employed in a conventional manner and amount. It is typically applied to the pulp in an amount of about 100 mg to 5 g per 100 g oven dried (O.D.) pulp.

Acidic conditions are required for reaction of the chelating agent. The pulp is typically adjusted to a pH in the range of approximately 1 to 5 and, more preferably, 2 to 3 using an acid such as sulfuric acid. Because the reduction in chlorinated by-products is a principal objective of the present invention, hydrochloric acid is preferably not used to make the pH adjustment.

The treatment of the pulp to remove transition metal ions is preferably conducted on a low consistency pulp, for example, a pulp having a consistency in the range of approximately 3 to 12%. This ensures that the chelating agent and acid coat the pulp fibers. After treatment with the chelating agent, the pulp is dewatered preferably by passage through a twin roll press. The consistency of the pulp is thereby increased to about 20% or greater and, more typically to about 20 to 35% and, most typically to about 20 to 25%. These higher consistencies are required for the subsequent delignification reaction which is a solid-gas heterogenous reaction, the effectiveness of which is controlled by oxygen/ozone mass transfer. By increasing the consistency of the pulp, faster reaction rates and a more efficient reaction condition are achieved; the reaction is focused on attacking the lignin on the surface of the pulp fibers.

The dewatered pulp is preferably treated with peracetic acid and low pressure steam in order to enhance the subsequent reaction with ozone and oxygen. Peracetic acid buffers the pulp at pH in the range of 1 to 6, and it reacts selectively with the lignin in the pulp. Accordingly, by treating the pulp with peracetic in this manner, the peracetic acid reacts with the lignin and opens up the fiber structure of the pulp. This allows the oxygen and ozone subsequently added to the pulp to infiltrate the pulp fiber and enhances their reaction on the pulp.

Generally, oxygen delignification processes are conducted under alkaline pH. The present process is unique in that the oxygen reaction is carried out under acidic conditions. While this reaction is generally less efficient under acidic conditions, by pretreating the pulp with the peracetic acid in this manner, the oxygen reaction under these conditions is enhanced.

The peracetic acid is added to the pulp as a solution in water having a concentration of approximately 40% to 50%(w/v). In order to enhance the reaction of the peracetic acid and open the fiber structure to enable the oxygen and ozone to react efficiently with the pulp, the peracetic acid is added to the pulp in an amount of about 0.5 to 5 g per 100 g O.D. pulp. The pulp is heated with low pressure steam to a temperature of approximately 50° to 60° C. In order to limit thermal damage to the pulp fibers, higher temperatures are preferably avoided at this stage of the process.

The peracetic acid and steam treated pulp is mixed as it is fed by a screw conveyor-mixer to a down flow retention tower. Preferably, the peracetic acid is allowed to react on the pulp for at least 5 minutes in the retention tower. The pulp may actually be retained in the tower for up to 1 or more hours. The peracetic acid tends to be exhausted early and the pulp is not damaged by further retention.

The next stage of the process of the invention is carried out under elevated pressures in a plug flow reaction tube. The pressures are typically about 40 to 120 psi. Magnesium sulfate solution, peracetic acid solution, and ozone/oxygen gas mixture are added to the pulp immediately upstream of a high shear mixer. Magnesium sulfate is added to the pulp as a viscosity protector. Other magnesium salts may be used for this purpose in a manner well known in the art. The magnesium salt is typically employed in an amount of approximately 0.5 to 5% wt. based upon O.D. pulp.

Peracetic acid is again added to the pulp, a typical amount for this addition being about 0.2 to 1.0%. This peracetic acid treatment fulfills three objectives: (1) it acts as a pH adjustor for the pulp for acid ozone/oxygen delignification, (2) it acts as an effective and selective delignifying agent in the presence of oxygen and ozone, and (3) it acts as a viscosity protector during the ozone treatment of the pulps. Both the delignifying efficiency and selectivity of the peracetic are believed to result in decreased ozone demand to treat the pulp, thus maintaining gas volumes at a manageable level.

The ozone/oxygen gas mixture contains from approximately 3 to 12% ozone based upon the total weight of the gas mixture. The ozone/oxygen gas mixture is preferably added to the pulp using a perforated gas sparger in an amount of about 0.2 to 2.0 g ozone per 100 g O.D. pulp. It is believed that by using low doses of ozone for pulp treatment, a stronger pulp than possible from a three-stage O-Z-Pa treatment can be produced.

Perforated gas spargers are commercially available. These spargers are designed to introduce the gas into the pulp as microbubbles. In adding the ozone/oxygen gas mixture to the pulp, it is important to avoid the formation of large bubbles which may produce channeling and lower mass transfer. The use of microbubbles accomplishes this objective.

Ozone is a very strong oxygenating agent and, therefore, it is necessary to control this stage of the delignification reaction so as not to degrade the cellulose. As previously indicated, the reaction is carried out in a plug flow reaction tube. Typically, the ozone reacts on the pulp for approximately 2 to 10 minutes. To limit the ozone reaction and thereby limit degradation of the pulp, it is preferable not to add additional heat to the reaction at this stage. Hence, the temperature of the pulp will be approximately 50° to 60° C. Once the plug exits the reaction tube, the ozone reaction is essentially complete and little or no unreacted ozone remains in the pulp. Accordingly, at this stage, the pulp can be heated to enhance the reaction of the oxygen.

For the oxygen reaction, the pulp is typically heated to a temperature of approximately 90° to 120° C. and pressurized to approximately 90 to 120 psi. To further enhance the oxygen reaction, the pulp is fluffed as it is introduced to a pressurized reactor vessel where the oxygen reacts on the pulp under the high temperature and high pressure conditions. This reaction requires approximately 10 minutes to 1 hour.

As illustrated in the attached drawing of the present invention, brownstock pulp from a pulp washer 10 at a consistency of about 10% is mixed with sulfuric acid and a chelant (EDTA) to chelate and passivate the transition metals in the pulp. Sulfuric acid is added to adjust the pH to about 3. The pulp is then fed to a twin roll press 12 for dewatering.

The pressate from the press 12 is returned via line 13 from which it is used to dilute the brownstock. This treatment acidifies the brownstock and reduces the amount of acid required to bring the pH of the pulp into the desired pH range. The pulp consistency after passage from the twin roll press is adjusted to about 20 to 25%. At the outlet of the twin roll press, the acidified pulp is mixed with peracetic acid from line 14 (0.5% w/w on O.D. pulp basis) and low pressure steam from line 15. The pulp temperature at this point is adjusted to 50°–55° C., respectively. The pulp is then fed through a mixer-feeder 16 (essentially a screw feeder) to a down flow retention tube 18.

At the end of the down flow retention tube, the pulp is pumped by a high consistency pump 20 such as a clove rotor pump to a high shear mixer 22. At the outlet of the high consistency pump 20, before the entrance to the high shear mixer 22, a compressed oxygen/ozone mixture of about 12% w/w ozone on oxygen is metered onto the pulp from feed 24 using a perforated gas sparget (not shown), and the pulp is mixed with magnesium sulfate and additional peracetic acid which are fed from reservoirs 26 and 28 respectively. The ozone charge on pulp is maintained at about 0.5% (w/w on o.d pulp basis). In the high shear mixer 22, the pulp is mixed with the reactants and then fed into a plug-flow tubular reactor 30. The pulp retention time in the tubular reactor 30 is adjusted to ensure the complete reaction with the pulp and consumption of the ozone (typically about 5 to 6 minutes is required). At the end of the tubular reactor 30 only the pulp, oxygen, magnesium sulfate and a small amount of unreacted peracetic acid remains. At this point, the pulp is pressurized to 0.6 to 0.8 MP and heated to about 100° C. with high pressure steam, in a steam mixer 32. This can be done without degrading the pulp at this stage.

Via fluffer 33 including rotating trays 34 and rotor 35, located at the top of the oxygen reactor 36, the pulp is fluffed and injected into oxygen reactor 36, thus increasing the interaction between the pulp and oxygen gas. High/medium consistancy oxygen reactors are available commercially, e.g., Kamyr high consistency tray type oxygen reactors. At the end of the fluffer 33, the pulp is diluted at 44 with the acid filtrate from the pulp washer pressate tank 42 and is then blown to a blow tank 46. The oxygen gas vented from the blow tank by outlet 48 may be reclaimed for the generation of ozone after proper clean up. Pulp from the oxygen blow tank exits via pump 50 for further treatment.

The process of the present invention is unique in that the entire treatment of the pulp is carried out under acidic conditions including the oxygen delignification of the pulp and the oxygen is derived from the ozone-oxygen gaseous mixture. The oxygen is activated to react under acidic conditions by using peracetic acid and by a thermal activation step. In this invention, unlike the conventional bleaching processes where oxygen delignification of pulp is carried out separately under alkaline condition, the treatment of pulp with peracetic acid, ozone and oxygen is carried out as a single operation (i.e., without intermediate washing steps) under acidic conditions.

By carrying out the delignification in a single-step and under high consistency, the hardware required to bleach the pulps is greatly reduced. Also, the volume of the liquor to be recirculated to the recovery plant is reduced to about $\frac{1}{3}$ to $\frac{1}{4}$ of the conventional oxygen-ozone processes. Since the practice of this invention does not require two different pH controls, the pH control strategy is simple and straight forward. The use of peracetic acid in the process results in lower kappa number and higher strength pulp than normally obtained from the conventional oxygen and ozone delignification process. This should result in a stronger bleached pulp of 90% ISO brightness at relatively lower chemical charge.

Following delignification, the delignified pulp may be alkali extracted in a conventional manner and bleached with either chlorine dioxide (D) and/or hydrogen peroxide (P) to yield a high strength and high brightness pulp. By using alkaline hydrogen peroxide instead of chlorine dioxide, a "zero-effluent" discharge can be achieved.

Other additives which are normally employed in conventional delignification and bleaching reactions may be employed in the present process.

Further variations and modifications of the foregoing will be apparent to those skilled in the art and are intended to be encompassed by the invention as defined in the appended claims.

What is claimed is:

1. A method for delignification and bleaching of cellulosic pulp which comprises:

adding a solution of peracetic acid to a cellulosic pulp slurry in an amount of about 0.5 to 5% based on the weight of O.D. pulp and heating said pulp to about 50° to 60° C., said slurry having a consistency of at least about 20% and a pH of about 1 to 5, wherein said peracetic acid reacts with said pulp;

introducing a gaseous mixture of ozone and oxygen to said cellulosic pulp under said acidic pH at a pressure of about 40 to 120 psi thereby principally reacting said ozone with said pulp until said ozone has substantially completely reacted with said pulp; and thereafter reacting said oxygen with said pulp under acidic pH at a pressure of about 90 to 120 psi and a temperature of about 90° to 120° C. thereby delignifying said pulp.

2. The method of claim 1 wherein said step of principally reacting said ozone with said pulp includes the additional steps of forming said pulp into a plug and transporting said plug through a plug flow reaction tube.

3. The method of claim 2 wherein the duration of said step of principally reacting said ozone with said pulp is approximately 2 to 10 minutes.

4. The method of claim 1 wherein said step of introducing said gaseous mixture of ozone and oxygen to said pulp further includes adding additional peracetic acid to said pulp.

5. The method of claim 1 wherein said step of introducing a gaseous mixture of ozone and oxygen to said pulp further includes adding a magnesium salt to said pulp.

6. The method of claim 1 wherein said method additionally comprises the step of pretreating said pulp with a chelating agent to passivate transition metal ions.

7. The method of claim 6 wherein, after treating said pulp to remove or passivate said transition metal ions, said method includes the step of dewatering said pulp to a consistency of at least 20%.

8. The method of claim 1 wherein said method is conducted in the absence of chlorine containing bleaching agents.

9. The method of claim 1 wherein said reactions with ozone and oxygen are carried out in a single stage without an intermediate washing step.

10. The method of claim 1 wherein immediately prior to said step of introducing said gaseous mixture of ozone and oxygen to said cellulosic pulp, additional peracetic acid solution is added to said pulp in an amount of about 0.2 to 1.0%.

11. In a method for delignification and bleaching of a cellulosic pulp which comprises reacting a cellulosic pulp with oxygen under conditions of alkaline pH in a first reaction stage and subsequently reacting said oxygen-treated pulp with ozone in an oxygen-containing carrier gas under conditions of acidic pH in a second reaction stage, said oxygen treated pulp being subjected to a washing stage between said first and said second reaction stages, the improvement which comprises reacting a cellulosic pulp with about 0.5 to 5% peracetic acid and low pressure steam at about 50° to 60° C., and subsequently carrying out said delignification and said bleaching of said cellulosic pulp in a single operation without dividing said process into separate stages divided by intermediate washing steps, wherein a gaseous mixture of ozone and oxygen are added to said cellulosic pulp under acidic pH of about 1 to 5, a pressure of about 40 to 120 psi and a temperature of about 50° to 60° C., thereby principally reacting said ozone with said pulp until said ozone has substantially completely reacted with said pulp and, thereafter, reacting said oxygen with said ozone-treated pulp under an acidic pH of about 1 to 5, a pressure of about 90 to 120 psi and a temperature of about 90° to 120° C., thereby delignifying said pulp; subjecting said delignified pulp to alkaline extraction; and bleaching said alkaline extracted pulp with alkaline hydrogen peroxide or chlorine dioxide.

12. The method of claim 11 wherein said method is conducted in the absence of chlorine containing bleaching agents.

13. The method of claim 11 wherein immediately prior to said step of introducing said gaseous mixture of ozone and oxygen to said cellulosic pulp, additional peracetic acid solution is added to said pulp in an amount of about 0.2 to 1.0%.

* * * * *